US005971812A

United States Patent [19]

Martin

[11] Patent Number: 5,971,812

[45] Date of Patent: Oct. 26, 1999

[54] MODULAR PLUG HAVING A CIRCUIT BOARD

[75] Inventor: Ralph Sykes Martin, Mount Airy, N.C.

[73] Assignee: The Whitaker Corporation, Wilmington, Del.

[21] Appl. No.: 08/977,544

[22] Filed: Nov. 25, 1997

[51] Int. Cl.[6] ..... H01R 23/62

[52] U.S. Cl. ..... 439/676

[58] Field of Search ..... 439/676, 418

[56] References Cited

U.S. PATENT DOCUMENTS

| | | | |
|---|---|---|---|
| 4,909,755 | 3/1990 | Chen | 439/676 |
| 5,069,641 | 12/1991 | Sakamoto et al. | 439/620 |
| 5,403,200 | 4/1995 | Chen | 439/676 |
| 5,421,741 | 6/1995 | David et al. | 439/77 |
| 5,766,027 | 6/1998 | Fogg | 439/76.1 |
| 5,830,005 | 11/1998 | Watanabe | 439/676 |
| 5,885,111 | 3/1999 | Yu | 439/676 |

*Primary Examiner*—Michael L. Gellner
*Assistant Examiner*—Briggitte R. Hammond
*Attorney, Agent, or Firm*—Robert J. Kapalka

[57] ABSTRACT

A modular plug electrical connector includes a dielectric housing which holds a plurality of terminals, a cavity which is open to the terminals, and a circuit board which is mountable in the cavity. The circuit board has an edge and an array of contact pads along the edge. Each of the terminals has a groove. The grooves are aligned to receive the edge of the circuit board and are dimensioned such that the terminals engage the contact pads within the grooves when the board is mounted in the cavity.

In an alternate embodiment a modular plug electrical connector includes a dielectric housing having a mating end, a plurality of slots which are open at the mating end, a cavity which is open to the slots, and a circuit board which is mountable in the cavity. The circuit board has an edge and a plurality of terminals along the edge. The terminals are installed in the housing as a unit with the circuit board and are exposed in the slots for engagement by terminals of a mating modular jack when the circuit board is mounted in the cavity.

11 Claims, 3 Drawing Sheets

MODULAR PLUG HAVING A CIRCUIT BOARD

FIELD OF THE INVENTION

The invention relates to a modular plug electrical connector having a circuit board that is coupled between external communications wires and terminals in the connector.

BACKGROUND OF THE INVENTION

Modular plugs and modular jacks are commonly used for interconnecting plural wires in a communications systems. Signal lines in a communications system are subject to crosstalk which increases in magnitude as operating frequencies of the system are increased. Previous efforts to reduce crosstalk have focused primarily on the crosstalk which occurs in the modular jack. The constant trend toward higher data transmission rates has resulted in a need for further crosstalk reduction which may be obtained by reducing crosstalk in the modular plug.

A new concept for reducing crosstalk in a modular plug involves adding a compensating insert to the modular plug. Details of this new concept are disclosed in a U.S. patent application which is being filed concurrently with the present application and which is owned by the assignee of the present application. In at least one embodiment of the new crosstalk reduction concept, the compensating insert includes a circuit board which is installed in a cavity in the modular plug. The circuit board carries conductive traces which are arranged at one end of the board to be connected to communications system wiring, and at the other end of the board to be connected to terminals of the modular plug. A problem to be solved by the present invention is how to connect the traces on the circuit board to the terminals of the connector.

SUMMARY OF THE INVENTION

According to one aspect of the invention, the problem is solved by a modular plug electrical connector comprising a dielectric housing which holds a plurality of terminals that are engageable with terminals of a mating modular jack. The housing has a cavity which is open to the terminals, and a circuit board which is mountable in the cavity. The circuit board has an edge and an array of contact pads along the edge. Each of the terminals has a groove. The grooves are aligned to receive the edge of the circuit board and are dimensioned such that the terminals engage the contact pads within the grooves when the board is mounted in the cavity.

According to another aspect of the invention, the problem is solved by a modular plug electrical connector comprising a dielectric housing having a mating end, a plurality of slots which are open at the mating end, a cavity which is open to the slots, and a circuit board which is mountable in the cavity. The circuit board has an edge and a plurality of terminals along the edge. The terminals are installed in the housing as a unit with the circuit board and are exposed in the slots for engagement by terminals of a mating modular jack when the circuit board is mounted in the cavity.

BRIEF DESCRIPTION OF THE DRAWINGS

The invention will now be described by way of example with reference to the accompanying drawings wherein.

DETAILED DESCRIPTION OF A PREFERRED EMBODIMENT

Figure 1:
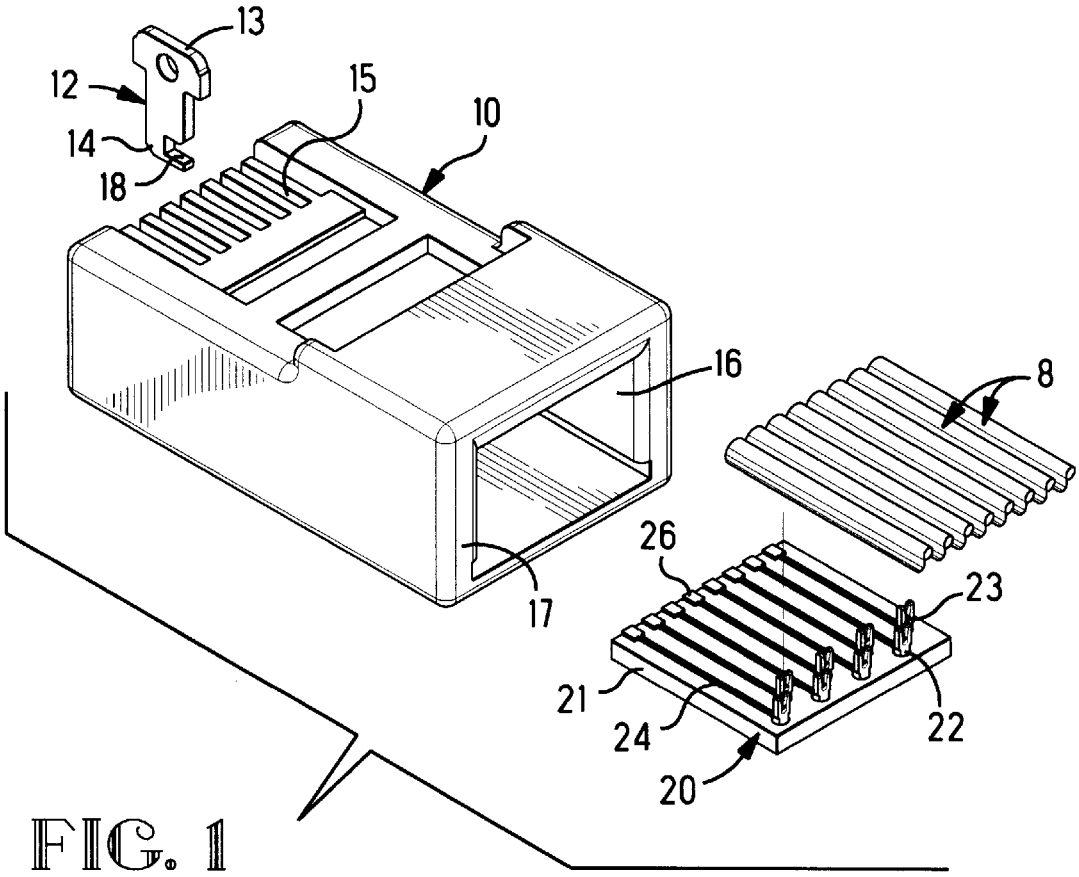
FIG. 1 is an exploded isometric view of a modular plug electrical connector according to the invention.
Figure 2:
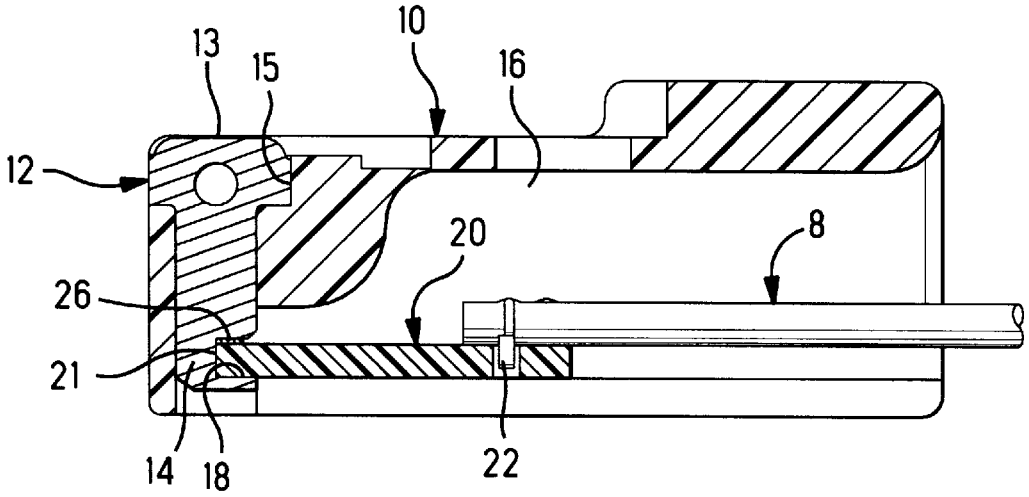
FIG. 2 is a cross-sectional view through the connector of FIG. 1.

There is shown in FIGS. 1 and 2 a modular plug electrical connector which is matable with a modular jack (not shown) for interconnecting a plurality of wires 8 in a communications system. Each of the wires includes a conductive core which is surrounded by a sleeve of insulation.

The modular plug connector comprises a dielectric housing 10 which holds a plurality of terminals 12, only one of which is shown, that are arranged side-by-side in respective slots 15. The housing has a cavity 16 which opens into the housing from a wire-receiving end 17 of the housing, and the cavity is open to the slots 15 at a termination end of the housing.

A circuit board 20 is mountable in the cavity 16. The circuit board holds a plurality of contact pins 22 which are configured to electrically connect with the plurality of wires 8. The contact pins may be insulation displacement-style contacts each having a pair of opposed beams which define a slot 23 wherein edges of the beams are configured to slice through the insulation of a respective wire and to engage the conductive core when the wire is installed in the slot. The board 20 carries conductive traces 24 which extend from the contact pins 22 to an array of contact pads 26 along a leading edge 21 of the board.

Each of the terminals 12 is a planar blade having a jack contacting portion 13 and a board contacting portion 14. The jack contacting portion 13 is exposed in the housing for engaging a terminal of a mating modular jack. The board contacting portion 14 is disposed in the cavity 16 for engaging the board 20 which is mounted in the cavity. The board contacting portion 14 is formed with a groove 18 that is bounded by edge surfaces of the terminal. All of the terminal grooves 18 are transversely aligned within the cavity so that the leading edge 21 of the board can be received within the grooves. An upper edge surface of each groove is arranged to engage one of the contact pads 26 when the board is mounted in the cavity. In this way, the wires 8 are electrically connected with the terminals 12 through the conductive traces 24 on the board.

Figure 3B:
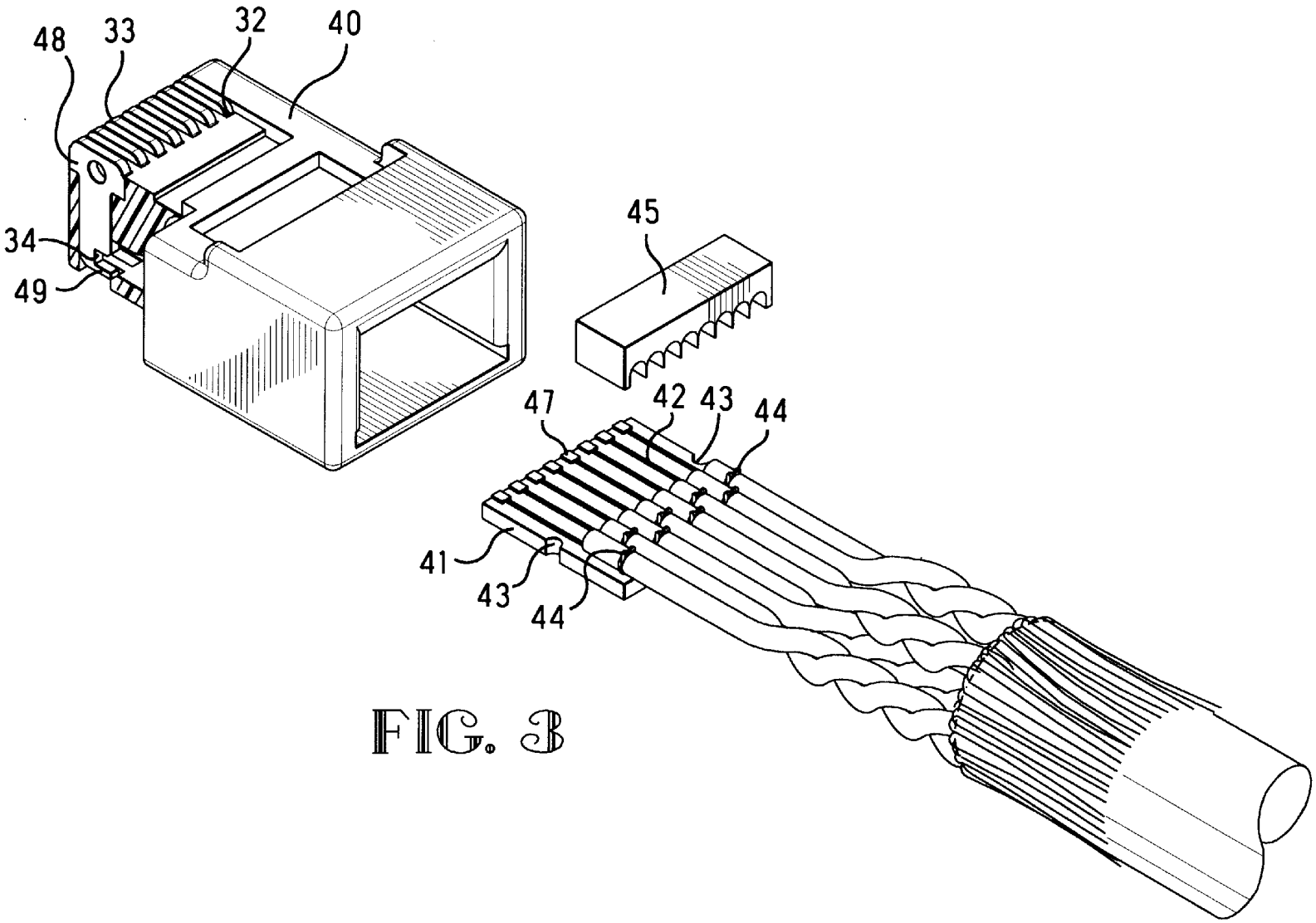
FIG. 3 is an isometric view of an alternate embodiment of the connector.

In an alternate embodiment as shown in FIG. 3, a modular plug connector includes a housing 40 having a cavity 46 which receives a circuit board 41. The circuit board 41 has conductive traces 42 with wire ends that are connected to insulation displacement contact pins 44 which can receive a stuffer cap 45. Additionally, terminal ends of the traces 42 are connected to an array of contact pads 47 at a leading edge of the board. The cavity 46 is open to terminals 48 which are carried by the housing in slots 32. Each of the terminals 48 has a jack contacting portion which is formed as a planar section having a terminal engaging surface 33, and a board contacting portion which is formed as a U-shaped section 49 that is open towards the cavity 46. An interior of each U-shaped section defines a groove 34 that is bounded by surfaces of the U-shaped section. The grooves 34 are aligned to receive the leading edge of the circuit board 41, and a surface of each U-shaped section 49 is arranged to engage one of the contact pads 47 when the board is installed in the cavity. The board has notches 43 which cooperate with latches in the housing to retain the board in the cavity.

Figure 4:
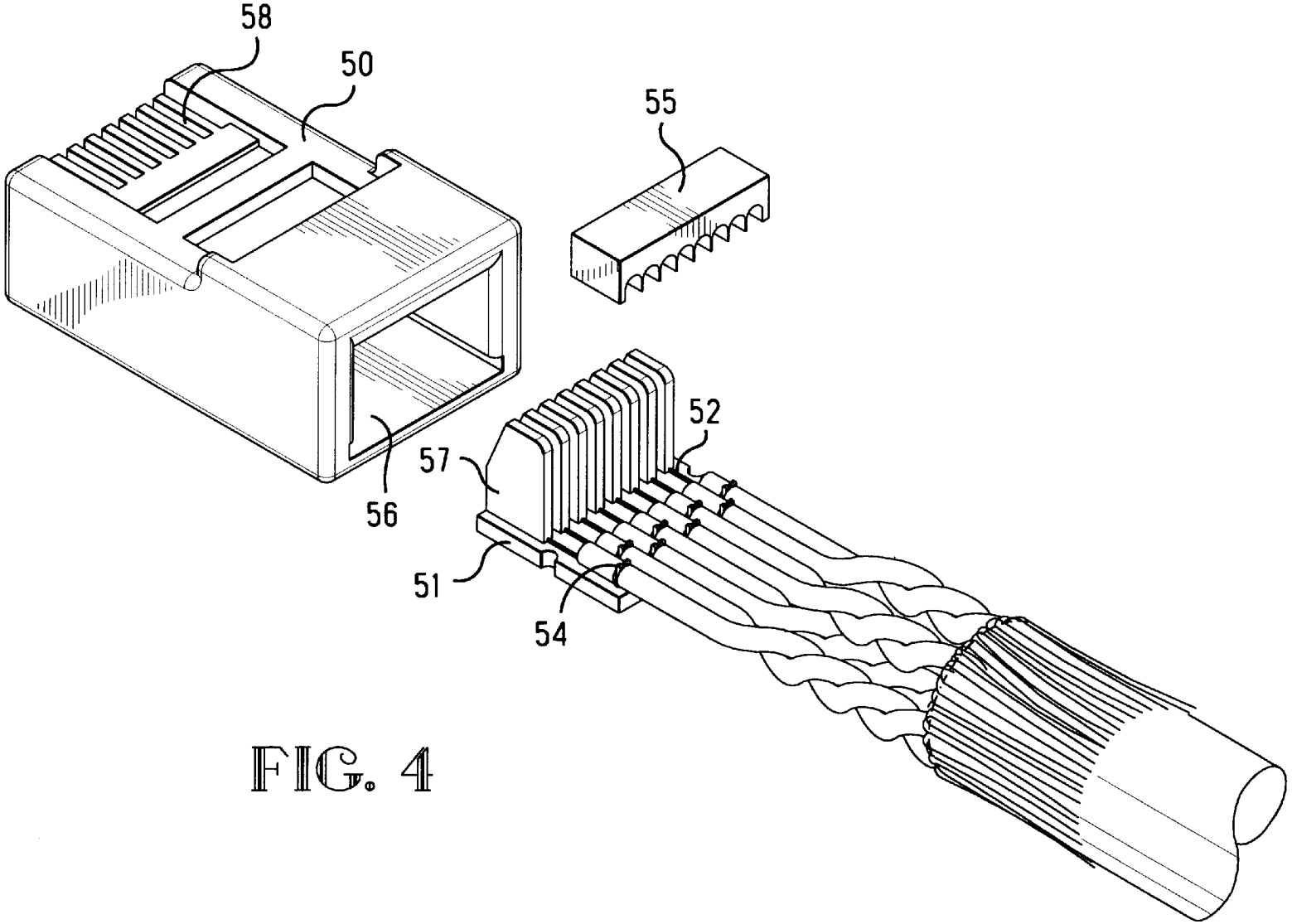
FIG. 4 is an isometric view of another alternate embodiment of the connector.

Another embodiment of the invention is shown in FIG. 4. A modular plug includes a housing 50 having a cavity 56 which is open to slots 58. The cavity receives a circuit board 51 having conductive traces 52 with wire ends that are connected to insulation displacement contact pins 54 which can receive a stuffer cap 55. Additionally, terminal ends of the traces 52 are connected to an array of parallel terminal blades 57 at a leading edge of the board. When the circuit board 51 is installed in the cavity 56, the terminal blades 57 enter the slots 58 and become exposed at a front mating face of the housing for engaging terminals of a mating modular jack.

The invention provides a means for electrically connecting conductive paths on a circuit board with terminals in a modular plug connector. According to one aspect of the invention, the terminals are mounted in the connector housing and are configured with grooves that receive an edge of the circuit board. According to another aspect of the invention, the terminals are mounted on the board and installed in the housing as a unit with the board.

The invention having been disclosed, a number of variations will now become apparent to those skilled in the art. Whereas the invention is intended to encompass the foregoing preferred embodiments as well as a reasonable range of equivalents, reference should be made to the appended claims rather than the foregoing discussion of examples, in order to assess the scope of the invention in which exclusive rights are claimed.

I claim:

1. A modular plug electrical connector comprising:

a dielectric housing which holds a plurality of terminals that are engageable with terminals of a mating modular jack, the housing having a cavity which is open to the terminals, a circuit board which is mountable in the cavity, the circuit board having an edge and an array of contact pads along the edge, each of the terminals having a groove, the grooves being aligned to receive the edge of the circuit board and being dimensioned such that the terminals engage the contact pads within the grooves when the board is mounted in the cavity.

2. The modular plug electrical connector of claim 1 wherein the terminals are planar bodies that are arranged in respective parallel planes, and each of the terminals has a notch which defines its said groove.

3. The modular plug electrical connector of claim 1 wherein each of the terminals has a stamped and formed U-shaped section which defines its said groove.

4. The modular plug electrical connector of claim 1 wherein the circuit board carries contact pins for terminating wires of a communications system.

5. A modular plug electrical connector comprising:

a dielectric housing having a mating end, a plurality of slots which are open at the mating end, and a cavity which is open to the slots, a circuit board which is mountable in the cavity, the circuit board having an edge and a plurality of terminals along the edge, the terminals being installed in the housing as a unit with the circuit board and being exposed in the slots, and are engageable with terminals of a mating modular jack when the circuit board is mounted in the cavity.

6. The modular plug electrical connector of claim 5 wherein the terminals are blades that are arranged in respective parallel planes.

7. The modular plug electrical connector of claim 6 wherein the circuit board carries contact pins for terminating wires of a communications system.

8. An electrical connector and cable assembly comprising:

a dielectric housing which holds a plurality of terminals that are engageable with terminals of a mating electrical connector, each of the terminals having a groove, the grooves being transversely aligned in a row, a circuit board having an edge and an array of contact pads along the edge, the circuit board being carried by the housing with the edge of the circuit board being disposed in the row of grooves and the contact pads being engaged with respective ones of the terminals, and a plurality of wires electrically connected to respective conductive traces on the circuit board and to respective ones of the contact pads.

9. The electrical connector and cable assemblly of claim 8 wherein the terminals are planar bodies that are arranged in respective parallel planes, and each of the terminals has notch which defines its said groove.

10. The electrical connector and cable assembly of claim 8 wherein each of the terminals has a stamped and formed U-shaped section which defines its said groove.

11. The electrical connector and cable assembly of claim 8 wherein the plurality of wires are terminated to respective contact pins on the circuit board.

* * * * *